United States Patent [19]

Evans et al.

[11] 4,103,129

[45] Jul. 25, 1978

[54] HIGH VOLTAGE CIRCUIT INTERRUPTER SWITCH ARRANGEMENT

[75] Inventors: David M. Evans, Palatine; Joel A. Ramos, Chicago, both of Ill.

[73] Assignee: S & C Electric Company, Chicago, Ill.

[21] Appl. No.: 775,904

[22] Filed: Mar. 9, 1977

[51] Int. Cl.[2] ..... H01H 33/02

[52] U.S. Cl. ..... 200/144 R; 200/144 C; 200/146 R; 200/149 A; 200/302

[58] Field of Search ..... 200/146 R, 144 R, 144 C, 200/149 A, 302

[56] References Cited

U.S. PATENT DOCUMENTS

| | | | |
|---|---|---|---|
| 3,909,570 | 9/1975 | Harner et al. | 200/146 R |
| 4,047,142 | 9/1977 | Bernatt et al. | 337/186 |

*Primary Examiner*—Robert S. Macon
*Attorney, Agent, or Firm*—Kirkland & Ellis

[57] ABSTRACT

A high voltage circuit interrupter is enclosed within an integral insulating housing that includes an operating mechanism enclosing portion, an insulator portion, and a muffler portion. The integrally formed insulating housing is formed to provide a groove in one interior wall of the operating mechanism enclosing portion and a similar groove is formed on the housing cover immediately opposite the groove in the wall so that a portion of the operating mechanism can ride in the grooves thereby eliminating certain internal metallic components. The operating shaft of the interrupter is hexagonal in cross section thereby eliminating the need for special machining, keys, and cross pins to attach operating levers to the shaft. Operating triggers having round bearing surfaces are inserted over the ends of the hexagonal shaft to provide a smooth running bearing fit with openings in the housing wall. A unique locking arrangement is utilized to lock the lever arm of the operating mechanism to the hexagonal shaft. Also, a bayonet type connection at the exhaust end of the interrupter unit permits a rain cap to be easily and conveniently attached to the interrupter unit.

15 Claims, 14 Drawing Figures

100
10
25
106
48
50
38
32
54
42
52
44
40
46
53
36
14
12
16
60
56
58
64
66
62
65
20
68
18
66
70
72
74
26
148
78
76
88
90
83
80
82
84
109
100
22
24
14
28
30
34
32
130
12
16
18
13
13
26

HIGH VOLTAGE CIRCUIT INTERRUPTER SWITCH ARRANGEMENT

BACKGROUND OF THE INVENTION

1. Field of the Invention

The present invention relates generally to high voltage circuit interrupting switches and more particularly to trailer-liner load interrupters suitable for high voltage systems, for example, in the range up to 34.5 kv.

2. Description of the Prior Art

Various types of high voltage circuit interrupter switch arrangements have been developed to provide efficient interruption of current flow in high voltage circuits. One type of circuit interrupter is disclosed in U.S. Pat. No. 3,909,570 — Harner et al., assigned to the same assignee as the present invention. This type of interrupter switch is commonly known as trailer-liner load interrupter which utilizes a contact trailer and arc chamber liner formed of a material that produces an arc quenching gas upon exposure to an electrical arc when the switch contacts are either opened or brought into proximity during closing. Such trailer-liner load interrupters are widely used at voltages up to 15 kv, and in some applications up to 34.5 kv. The present invention is an improvement over the circuit interrupter disclosed in U.S. Pat. No. 3,909,570 — Harner et al. and is also capable of effective current interruption at ranges up to 34.5 kv.

BRIEF DESCRIPTION OF THE INVENTION

An improved high voltage circuit interrupter switch arrangement for interrupting current flow in an electrical circuit in accordance with the present invention is adapted specifically for utilization in an integrally formed hollow unitary housing formed of an insulating material. The housing includes an operating mechanism enclosing portion having a hollow interior, an insulator portion having a hollow interior, and a muffler portion having a hollow interior, and each of the hollow interiors communicate with one another. A stationary contact is mounted within the hollow interior of the insulator portion, and a movable contact normally engages the stationary contact.

An improvement in accordance with the present invention comprises a cover for sealing an opening in a side wall of the operating mechanism enclosing portion of the housing. The cover has a circular opening formed therethrough and a groove formed on the interior surface of the cover. A groove is also formed on the interior surface of the operating mechanism enclosing portion of the housing opposite the position of the groove on the cover when the cover is sealed over the opening in the housing. A circular opening is formed through a side wall of the operating mechanism enclosing portion of the housing opposite the circular opening in the cover. A polygon-shaped shaft is positioned so that one end thereof is located in the circular opening in the cover, and the other end is located in the circular opening in the housing. First and second trigger members having a circular portion that slidably mates with the circular openings in the cover and the housing have a polygon-shaped recess in the end of the circular portion that mates with the end of the polygon-shaped shaft. The triggers are attached to the polygon-shaped shaft so that when the trigger members are pivoted, the shaft rotates. A first lever arm assembly is locked at one end thereof to the polygon-shaped shaft. A second lever arm assembly is pivotably connected to the other end of the first lever arm assembly intermediate the ends of the second lever arm assembly. The second lever arm assembly is pivotably connected at one end to the movable contact rod. A guide pin is attached to the other end of the second lever arm assembly, and the guide pin is dimensioned to engage and slidably ride in the grooves in the housing and cover. Means are provided for biasing the guide pin towards the polygon-shaped shaft.

The first lever arm assembly comprises first and second arms having a polygon-shaped opening through one end thereof dimensioned to slidably mate with the polygon-shaped shaft. A separator member having a polygon-shaped opening therethrough is dimensioned to slidably mate with the polygon-shaped shaft and is positioned between the first and second arms. The separator member has a pin extending from opposite surfaces of the separator member which engage the first and second arms adjacent the opening in said arms to hold the end of the arms separated. Means are provided to squeeze the first and second arms together intermediate their ends to cause the first and second arms to bend so that the opening in the first and second arms engages the polygon-shaped shaft locking said the first and second arms to the polygon-shaped shaft.

A rain cap can be positioned over an open end of the muffler portion of the housing and locked over the open end of the housing by a bayonet-type locking arrangement.

In addition, a shunt assembly including terminal buttons, screw terminal and an internal stress shield electrically connected by a connector member can be molded into the housing so that the terminal buttons extend partially from the surface of the housing. The screw terminal of the shunt assembly is electrically connected to the first lever arm assembly to assure electrical connection.

Thus, it is a primary object of the present invention to provide an improved high voltage circuit interrupter switch arrangement which permits elimination of portions of the operating mechanism by utilizing grooves in the housing wall to act as part of the structure of the operating mechanism.

Yet another object of the present invention is to provide an improved high voltage circuit interrupter switch arrangement that utilizes a unique means of locking the lever arms of the operating mechanism to a polygon-shaped shaft so that costly machining and fastening of the shaft can be eliminated.

Yet another object of the present invention is to provide an improved high voltage circuit interrupter switch arrangement that eliminates the necessity of expensive and time consuming machining of portions of the operating mechanism by molding smooth running bearing surfaces directly on the housing.

These and other objects, advantages, and features, shall hereinafter appear, and for the purposes of illustration, but not for limitation, an exemplary embodiment of the present invention is illustrated in the accompanying drawings.

DETAILED DESCRIPTION OF THE PREFERRED EMBODIMENTS

Figures 1, 2:
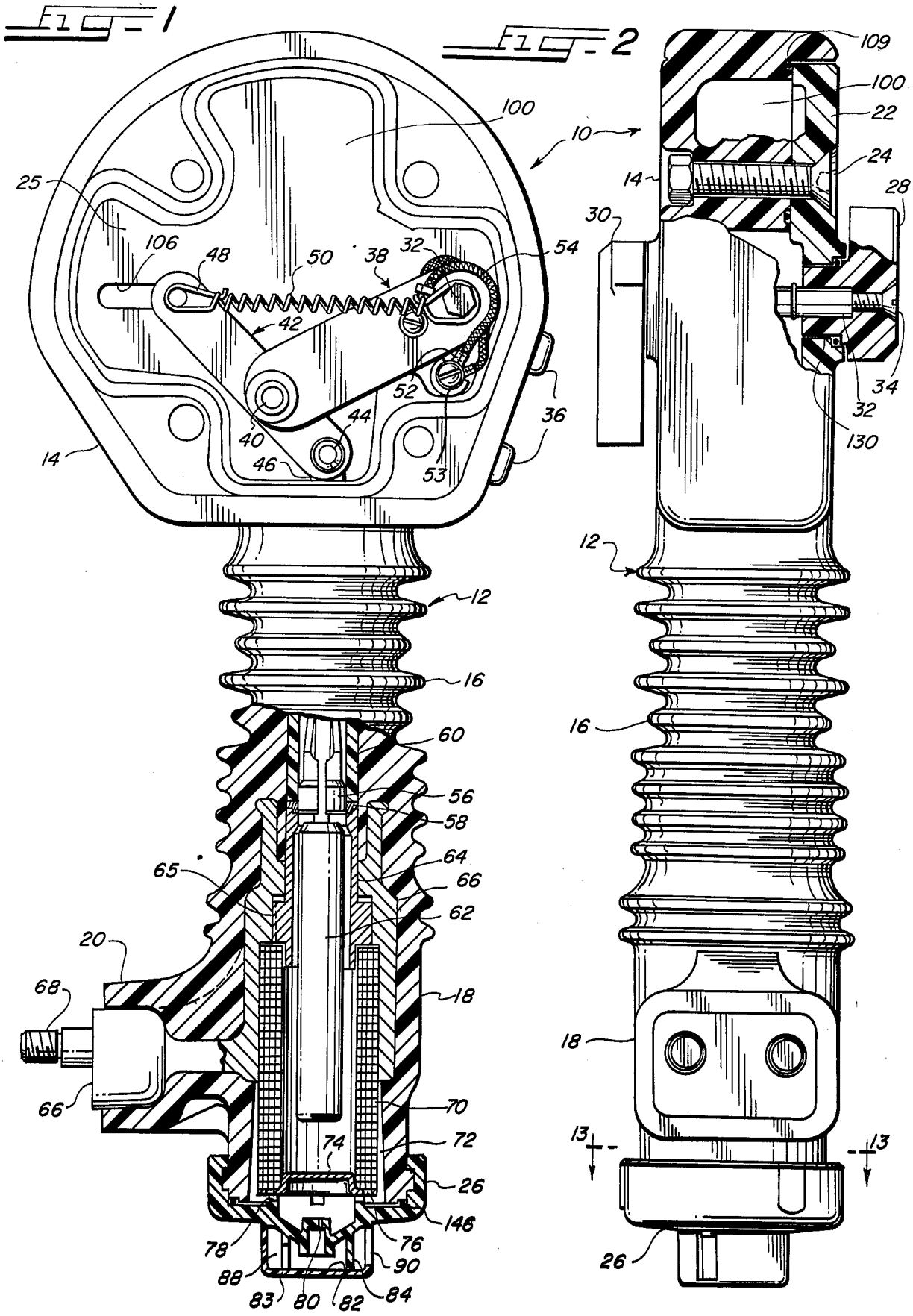
FIG. 1 is a side partially cross-sectional view of a preferred embodiment of the present invention with cover removed from the upper portion thereof.
FIG. 2 is an end partially cross-sectional view of the embodiment illustrated in FIG. 1 with the cover in position.

With reference to FIGS. 1 and 2, interrupter switch arrangement 10 comprises housing 12 molded of insulating material, such as epoxy resin, and preferably cycloaliphatic epoxy resin. Housing 12 includes operating mechanism enclosing portion 14, insulator portion 16 and muffler portion 18, all of which are integrally molded together. Also integrally molded to the insulator and muffler portions of the housing is mounting flange 20. A cover 22 can be bolted by bolts 24 (see FIG. 2) over the opening 25 in the side of operating mechanism enclosing portion 14 of housing 12. Cover 22 can also be glued by epoxy cement over opening 25. FIG. 1 illustrates the housing with the cover 22 removed so that the operating arms are exposed whereas FIG. 2 shows the cover 22 in is sealed position.

A rain cap 26 is mounted over the end of the muffler portion of the housing 12 by a bayonet connection that will be more thoroughly described hereinafter. Except for the means of connection, rain cap 26 is substantially the same as that described and illustrated in co-pending application Ser. No. 741,023, filed Nov. 11, 1976, assigned to the same assignee as the present invention.

Trigger arms 28 and 30 are mounted to a polygon-shaped and preferably hexagon-shaped shaft 32 by screws 34. Electrical terminal buttons 36 extend through the side of housing 12 and are electrically connected to the internal operating portions of the switch arrangement 10 in a manner that will be more fully described later. Mounted on hexagonal shaft 32 is a first lever arm assembly 38 that pivots with shaft 32. The end of first lever arm assembly 38 is pivotably connected by a pin 40 to a second lever arm assembly 42 intermediate its ends. Second lever arm assembly 42 is pivotably connected at one end by a pin 44 to a contact rod 46. Mounted through the other end of second lever arm 42 is a guide pin 48 over which is attached one end of a spring 50. The other end of spring 50 is hooked around shaft 32. Spring 50 biases guide pin 48 towards shaft 32.

Figure 14:
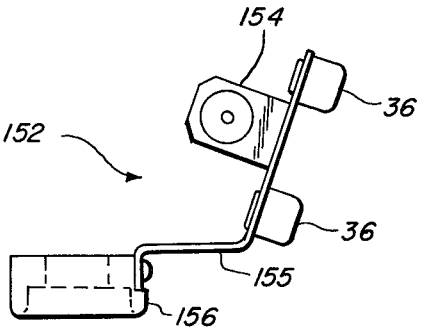
FIG. 14 is a side view of the shunt assembly of the present invention.

Terminal buttons 36 are formed of copper and are a part of shunt assembly 152 which includes screw terminal 154 and internal stress shield 156 (see FIG. 14) which are electrically connected together by connector 155. The end 52 of contact wires 54 are attached by a screw 53 to screw terminal 154 to provide an electrical connection to arms 38 and 42. Shunt assembly 152 is molded into housing 12 when housing 12 is molded.

Formed on the end of contact rod 46 is a movable contact head 56. Movable contact 56 engages stationary contact 58 when the switch is in the closed position. A liner 60 is positioned around movable contact 56 and is fabricated of material that produces an arc extinguishing gas when exposed to an electrical arc. Mounted to the end of contact rod 46 is a trailer 62. Trailer 62 is formed of a material that produces an arc inhibiting gas upon exposure to an electrical arc. A metallic sleeve 64 with stationary contact 58 affixed to its upper end is threaded by threads 65 into a threaded opening in a contact adapter 66. Contact adapter 66 extends to the end of mounting flange 20 and mounting studs 68 are attached to the end of contact adapter 66.

A sleeve of screen wire 70 is positioned within the interior 72 of muffler portion 18 of housing 12. Wire 70 is held in position by a plate 74 which has a series of small openings 76 around the periphery thereof which communicate with grooves 78 in the base of rain cap 26 so that arc gases can be vented to rain cap 26 when the switch operates.

Rain cap 26 has an opening 80 that communicates with a chamber 82. Chamber 82 is surrounded by wall 84 having at least one slot 86 that communicates with an annular chamber 88. Chamber 88 communicates with the atmosphere through at least one slot 90. Thus arc gases are vented to the atmosphere through rain cap 26 when the switch operates.

Figure 3:
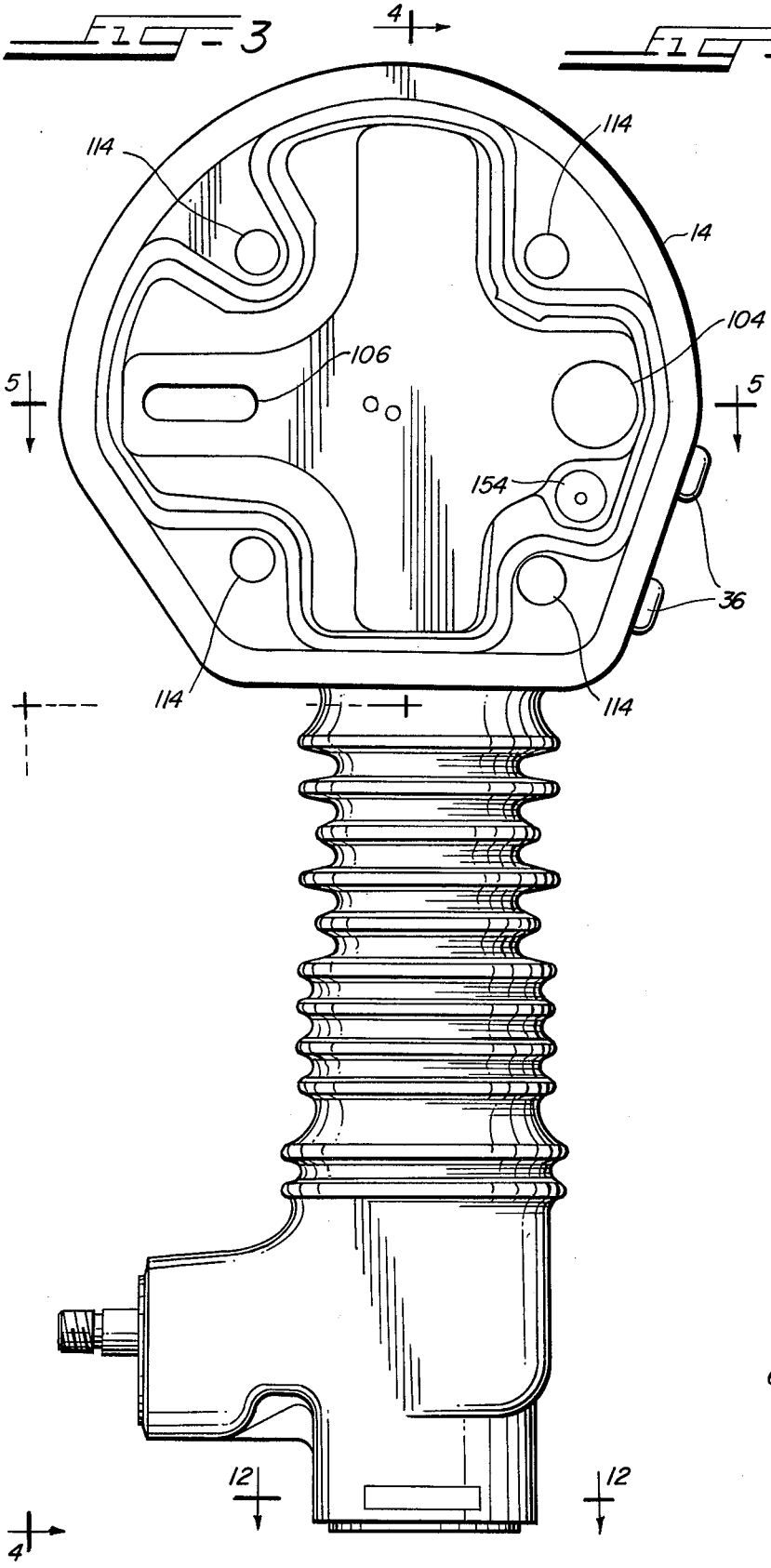
FIG. 3 is a side elevational view of the molded housing of the present invention.
Figure 4:
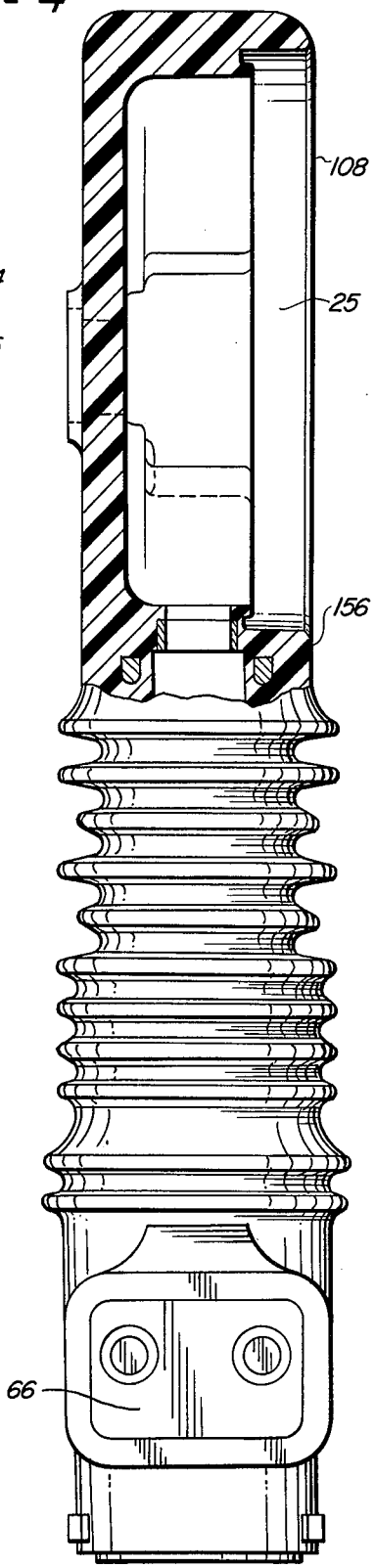
FIG. 4 is an end partially cross-sectional view of the molded housing illustrated in FIG. 3.

The operating enclosing portion 14 of housing 12 is fabricated with a hollow interior 100 is that is especially adapted to receive the operating mechanism of the present invention. With reference to FIGS. 3 and 4, housing 12 is integrally molded around contact adapter 66 and shunt assembly 152 so that buttons 36 project as shown. A round opening 104 is integrally molded to receive the trigger arm 30 and a groove 106 is integrally molded into the interior wall of the operating enclosing portion 14 of the housing 12. Groove 106 receives the end of guide pin 48 as illustrated in FIG. 1.

Figure 5:
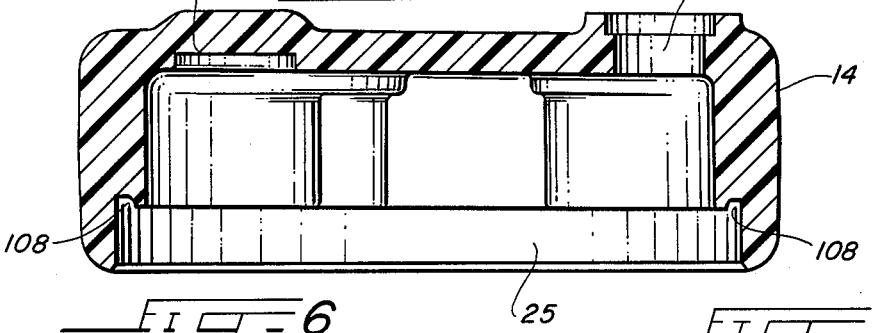
FIG. 5 is a top cross-sectional view taken substantially along line 5—5 in FIG. 3.
Figure 6:
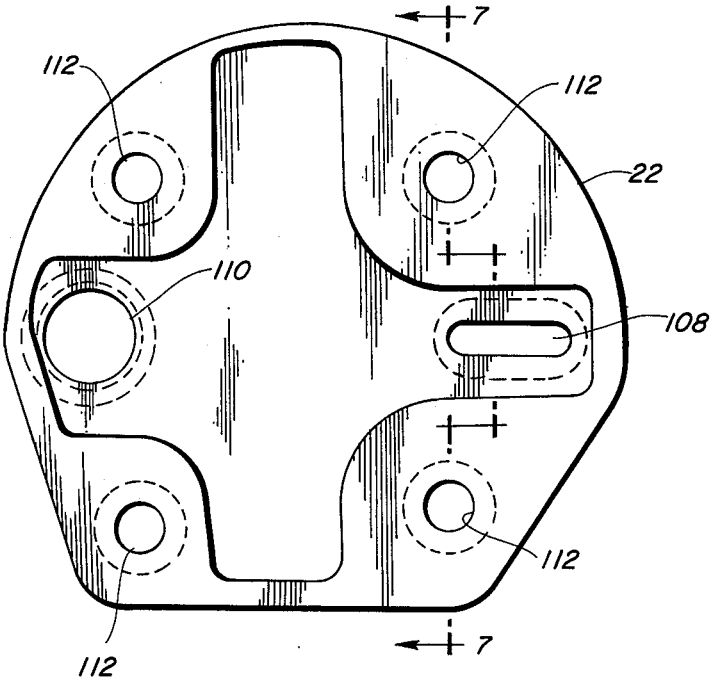
FIG. 6 is a plane view of the inside of the cover for the housing of the preferred embodiment illustrated in FIG. 1.
Figure 7:
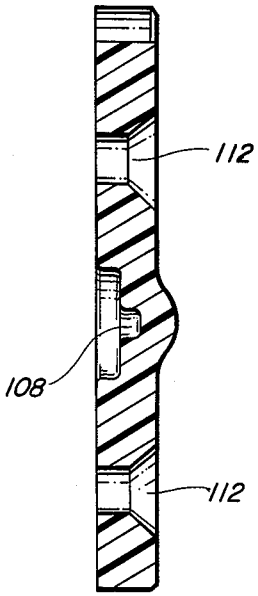
FIG. 7 is a cross-sectional view taken substantially along line 7—7 in FIG. 6.

With reference to FIGS. 4 and 5, it can be seen that the operating mechanism enclosing portion 14 has an opening 25 for receiving cover 22. Opening 25 has an O-ring groove 108 formed around the periphery thereof for receiving an O-ring 109 (see FIG. 2) to effectuate a seal when cover 22 is bolted over opening 25. With reference to FIGS. 6 and 7, it can be seen that the interior surface of cover 22 has a groove 108 formed thereon at a position exactly opposite groove 106 in housing 12. Cover 22 also has an opening 110 formed therethrough that is positioned exactly opposite opening 104 when cover 22 is placed over opening 25. Opening 110 is dimensioned to receive the rounded circular portion 150 of trigger 28. Also formed through cover 22 are bolt holes 112 which align with bolt holes 114 in housing 12.

Figure 9:
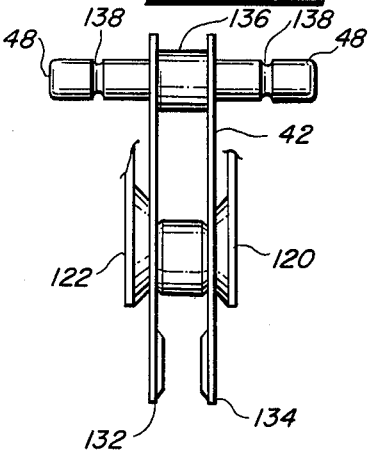
FIG. 9 is a partially cross-sectional view taken substantially along line 9—9 in FIG. 8.
Figure 8:
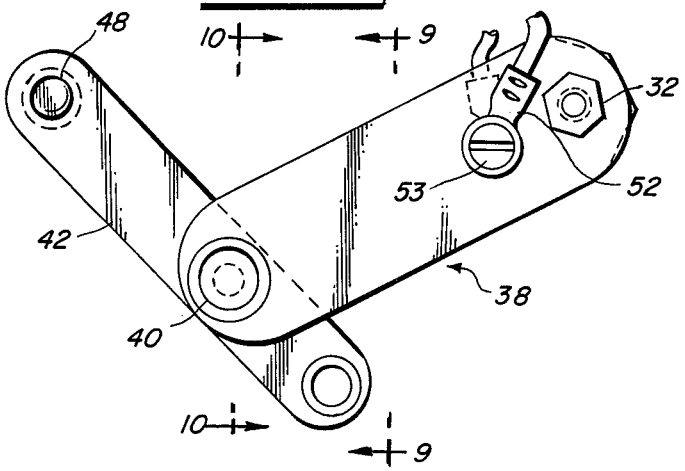
FIG. 8 is a side plane view of the operating lever arms of the operating mechanism of the preferred embodiment.
Figure 10:
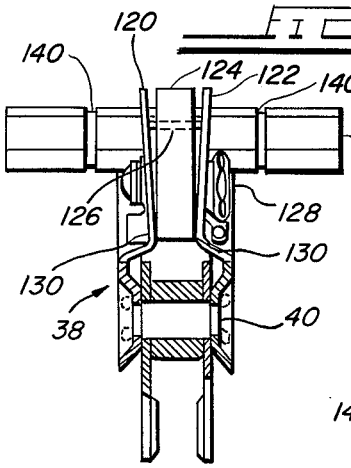
FIG. 10 is partially cross-sectional view taken substantially along line 10—10 in FIG. 8.

With reference to FIGS. 8, 9, and 10, first lever arm assembly 38 comprises two arms 120 and 122 held together at one end by pin 40. Arms 120 and 122 have a hexagonal opening through the other end thereof that slidably mates with shaft 32. A separator block 124 is positioned between the ends of arms 120 and 122, and separator block 124 also has a hexagonal opening that slidably mates with shaft 32. Inserted through a small hole in separator block 124 is a spreading means in the form of locking pin 126 that extends from both surfaces of separator block 124. A nut and bolt 128 is also inserted through an opening in arms 120 and 122 and an opening in separator block 124. When nut and bolt 128 are loose, the mid-portion 130 of arms 120 and 122 tend to spring away from separator block 124. In the loosened position, first lever arm assembly 38 can be inserted over shaft 32 to the mid-position as illustrated in FIG. 10. In this position, nut and bolt 128 can be tightened causing pin 126 to hold the ends of arms 120 and 122 separated while the mid-portion 130 is tightened against the separator block 124 causing the edges of the hexagonal opening through arms 120 and 122 to bind against the edge of shaft 32 thereby locking the first lever arm assembly to shaft 32.

Second lever arm assembly 42 comprises two arms 132 and 134 which are pivotably mounted to arms 120 and 122 by pin 40. Guide pin 48 extends through a separator 136 which holds the ends of arms 132 and 134 in a separated position. Spring grooves 138 are provided in the ends of guide pin 48 to provide a recess for end of springs 50. Similarly, shaft 32 has spring grooves 140 for receiving the end of springs 50.

Figure 12:
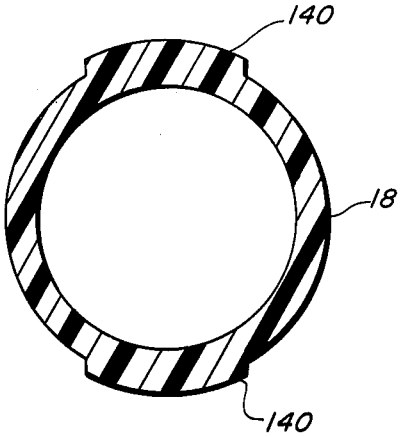
FIG. 12 is a cross-sectional view taken substantially along line 12—12 in FIG. 3.
Figure 13:
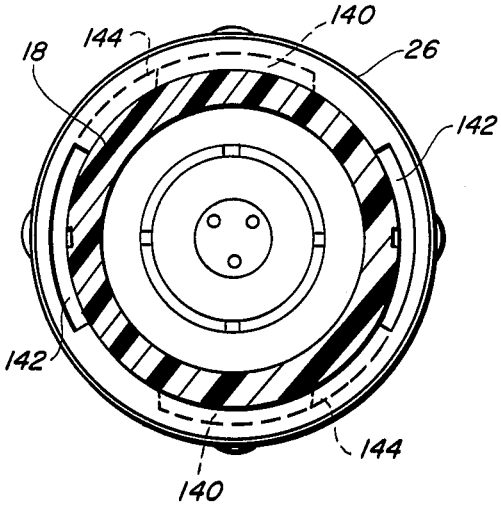
FIG. 13 is a cross-sectional view taken substantially along line 13—13 in FIG. 2.

With reference to FIGS. 12 and 13 the end of muffler portion 18 has formed on the periphery thereof ears 140 which extend outwardly therefrom. Ears 140 are adapted to be inserted into a co-mating groove 142 in rain cap 26. When rain cap 26 is rotated, ears 140 are pivoted under the edge of a flange 144 until ears 140 reach the position illustrated in FIG. 13. In this position, rain cap 26 is locked over the open end of muffler portion 18 and an O-ring 146 (see FIG. 1) provides a moisture seal as well as a resilient lock.

Assembly of the switch arrangement 10 is particularly facilitated by the unique design of the components described herein. Housing 12 is initially molded from epoxy resin with contact adapter 66 and shunt assembly 152 molded into the housing 12 as indicated. To assemble, liner 60 is first inserted through the hollow open end of muffler portion 18 into the hollow interior of insulator portion 16. Stationary contact 58, affixed to sleeve 64 follows liner 60 as sleeve 64 is then screwed into contact adapter 66. Contact rod 46 and trailer 62 can then be inserted. First and second lever arm assemblies 38 and 42 which have previously been attached to shaft 32 in the manner described are inserted to the position illustrated in FIG. 1 so that guide pin 48 rides in groove 106 and shaft 32 extends through opening 104. Trigger arm 30 which has a hexagonal opening formed therein to receive shaft 32 is inserted over the end of shaft 32 and attached by a screw 34.

With reference to FIG. 2, it can be seen that trigger arms 28 and 30 which are substantially the same, have a circular portion 150 dimensioned to fit into circular openings 104 in housing 12 and circular opening 110 in cover 22. This circular portion 150 is dimensioned to a slidable bearing fit so the trigger arms can rotate freely without appreciable slack. Once lever arm assemblies 38 and 42 are in the position illustrated in FIG. 1, the end of second lever arm assembly arm 42 is attached to contact rod 46 by pin 44. The ends 52 of contact wires 54 are then attached by a screw 53 to screw terminal 154 of shunt assembly 152. O-ring 109 is assembled in O-ring groove 108 formed around the periphery of opening 25. Cover 22 is first placed over opening 25 in operating mechanism enclosing portion 14 so that groove 108 engages the other end of guide pin 48 and shaft 32 is positioned in opening 110, and then bolted through matching bolt holes 112 of cover 22 and bolt holes 114 in housing 12 by bolts 24. Trigger arm 28 can then be placed over the end of shaft 32 to the position illustrated in FIG. 2 and attached by a screw 34. Screen wire sleeve 70 and plate 74 can then be inserted into the muffler portion 18 and rain cap 26 can be attached as previously described.

The present invention has several features which are particularly advantageous over the prior art. First, by utilization of grooves 106 and 108, the housing itself becomes a portion of the operating mechanism thereby allowing the elimination of unnecessary metal parts and reducing the cost of manufacture. Further, the means of locking the first lever arm assembly 38 to shaft 32 illustrated in FIG. 10 facilitates assembly and eliminates the necessity of costly machining of shaft 32. Further, by allowing shaft 32 to be hexagonal in shape, first lever arm assembly 38 can be rigidly attached to shaft 32 without the necessity of complex assembly fixtures, pins or other attachments. In addition, by providing a rounded portion 150 on the trigger arms 28 and 30 which provide the bearing surface for rotation of arms 28 and 30 in shaft 32, it is unnecessary to machine shaft 32 to a round shape.

Trigger arms 28 and 30 are designed to be engaged by driving members of a high voltage switch arrangement (not shown) to effect operation of the circuit interrupter to its open or its closed position. Springs 50 tend to retain the interrupter in either the open or the closed position. During operation between these positions, springs 50 are extended in the first half of the operation, after which they retract to cause a snap action to complete the operating stroke.

Figure 11:
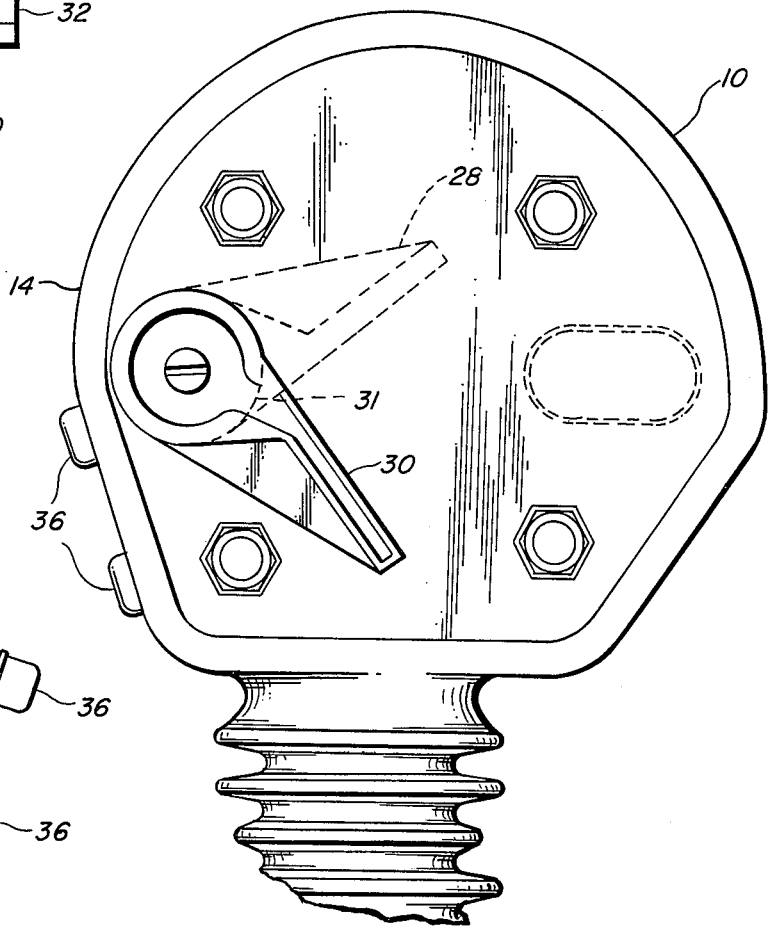
FIG. 11 is a partially fragmentary view of the upper portion of the preferred embodiment of the present invention illustrating the position of the operating triggers.

In certain arrangements, a trigger arm is required on only one side of the circuit interrupter. In such cases, the arm portion of one trigger arm is omitted, leaving only a circular journal as shown by dashed line 31 in FIG. 11. Also, trigger arms 28 and 30 could take a variety of shapes as long as they act as journal members to effectuate rotation of shaft 32.

Thus, it should be apparent that the present invention provides many unique and desirable improvements over the prior art. Further, it should be apparent that various changes, alterations and modifications to the embodiment described herein can be made without departing from the spirit and scope of the present invention as claimed in the attached claims.

We claim:

1. In a high voltage circuit interrupter arrangement for interrupting current flow in an electrical circuit including an integrally-formed hollow unitary housing formed of an insulating material, the housing including an operating mechanism enclosing portion having a hollow interior, and an interrupter portion having a hollow interior, the hollow interiors communicating with one another, a stationary contact mounted within the hollow interior of said interrupter portion, a movable contact normally engaging the stationary contact, an improvement comprising:

a cover for closing an access opening in a side wall of the operating mechanism-enclosing portion of the housing, said cover having a circular opening formed therethrough and a groove formed in an interior surface of said cover;

a groove formed on an interior surface of the operating mechanism enclosing portion of the housing opposite said groove in said cover when said cover is in place over said access opening in the housing;

a circular opening through a side wall of the operating mechanism enclosing portion of the housing opposite said circular opening in said cover when said cover is in place over said access opening;

a shaft, said shaft positioned so that one end thereof is located in said circular opening in said cover, and the other end is located in said circular opening in the housing;

at least one trigger member, said at least one trigger member being attached to an end of said shaft so that when said trigger member is pivoted, said shaft rotates;

a first lever arm assembly locked at one end thereof to said shaft;

a second lever arm assembly pivotably connected to the other end of said first lever arm assembly intermediate the ends of said second lever assembly; said second lever arm assembly being pivotably connected at one end to the movable contact;

a guide pin attached to the other end of said second lever arm assembly said guide pin dimensioned to engage and slidably ride in said grooves in said housing and said cover, whereby motion of the other end of said second lever is defined by said grooves in said housing and said cover.

2. An improvement, as claimed in claim 1, wherein said shaft is polygon-shaped, and said at least one trigger member has a circular portion which slidably mates with said circular openings in said cover and said housing, and further has a polygon-shaped recess in the end of said circular portion that mates with the end of said polygon-shaped shaft.

3. An improvement, as claimed in claim 2, wherein said first lever arm assembly comprises:

first and second arms, said arms having an opening through one end thereof shaped to fit over and dimensioned to slidably mate with said polygonal-shaped shaft;

a separate member having an opening therethrough similarly shaped and dimensioned to slidably mate with said polygonal-shaped shaft being positioned between said first and second arms, said separate member having spreading means extending from opposite surfaces of said separator member engaging the first and second arms adjacent the opening in said arms to hold said first and second arms separated;

fastening means cooperating with said spreading means to cause said first and second arms to bend so that the openings in said first and second arms engage said polygonal-shaped shaft in a locking relationship.

4. An improvement, as claimed in claim 1, further comprising a rain cap positioned over an open end of the interrupter portion of the housing, said rain cap having grooves thereon that engage ears formed on the exterior of the interrupter portion to disengagably attach said rain cap to said interrupter portion.

5. An improvement, as claimed in claim 1, wherein said cover is bolted to the housing to seal said access opening in the side wall of the operating portion of the housing.

6. An improvement, as claimed in claim 1, wherein said cover is glued to the housing to seal said access opening in the side wall of the operating portion of the housing.

7. An improvement, as claimed in claim 1, further comprising a shunt assembly including terminal buttons, a screw terminal, and an internal stress shield electrically connected by a connector member, said shunt assembly being molded into the housing so that said terminal buttons extend partially from the surface of the housing, and said screw terminal being electrically connected to said first lever arm assembly.

8. In a high voltage circuit interrupter arrangement for interrupting current flow between two terminals in an electrical circuit including an integrally formed hollow unitary housing formed of an insulating material, the housing including an operating mechanism-enclosing portion having a hollow interior, and an interrupter portion, having a hollow interior, the hollow interiors communicating with one another, a stationary contact mounted within the hollow interior of said interrupter portion, a movable contact normally engaging the stationary contact, an improvement comprising:

a cover for closing an access opening in a side wall of the operating mechanism enclosing portion of the housing, said cover having a circular opening formed therethrough and a groove formed in an interior surface of said cover;

a groove formed on an interior surface of the operating mechanism enclosing portion of the housing opposite said groove in said cover when said cover is in place over said access opening in the housing;

a circular opening through a side wall of the operating mechanism enclosing portion of the housing opposite said circular opening in said cover when said cover is in place over said access opening;

a polygon-shaped shaft, said shaft positioned so that one end thereof is located in said circular opening in said cover, and the other end is located in said circular opening in the housing;

means external to said housing and said cover affixed to said polygon-shaped shaft for rotating said shaft;

a first lever arm assembly inside said housing locked at one end thereof to said polygon-shaped shaft;

a second lever arm assembly pivotably connected to the other end of said first lever arm assembly intermediate the ends of said second lever assembly; said second lever arm assembly being pivotably connected at one end to the movable contact;

a guide pin attached to the other end of said second lever arm assembly said guide pin dimensioned to engage and slidably ride in said grooves in said housing and said cover whereby motion of the other end of said second lever is defined by said grooves.

9. An improvement, as claimed in claim 8, wherein said first lever arm assembly comprises:

first and second arms, said arms having a polygon-shaped opening through one end thereof dimensioned to slidably mate with said polygon-shaped shaft;

an intermediate member having a similarly-shaped opening therethrough dimensioned to slidably mate with said polygon-shaped shaft being positioned between said first and second arms, said intermediate member having opposite surfaces facing said first and second arms, said surfaces being normally not co-planar with said arms;

means for squeezing said first and second arms against said opposite surfaces to bend said first and second arms to cause said polygon-shaped openings therein to bind said polygon-shaped shaft, thereby locking said first and second arms thereto.

10. An improvement, as claimed in claim 8, further comprising a rain cap positioned over an open end of the interrupter portion of the housing, said rain cap having grooves thereon that engage ears formed on the exterior of the interrupter portion to disengagably attach said rain cap to said interrupter portion.

11. An improvement, as claimed in claim 8, wherein said cover is bolted to the housing to seal said access opening in the side wall of the operating portion of the housing.

12. An improvement, as claimed in claim 8, wherein said cover is glued to the housing to seal said access opening in the side wall of the operating portion of the housing.

13. An improvement, as claimed in claim 8, further comprising a shunt assembly including terminal buttons, a screw terminal, and an internal stress shield electrically connected by a connecting member, said shunt assembly being molded into the housing so that said terminal buttons extend partially from the surface of the housing, and said screw terminal being electrically connected to said first lever arm assembly.

14. In a high voltage circuit interrupter arrangement for interrupting current flow between two terminals in a circuit including an integrally formed hollow unitary housing formed of an insulating material, the housing including an operating mechanism enclosing portion having a hollow interior, and an interrupter portion, having a hollow interior, the hollow interiors communicating with one another, a stationary contact mounted within the hollow interior of said interrupter portion, a movable contact normally engaging the stationary contact, an improvement comprising:

a cover for closing an access opening in a side wall of the operating mechanism-enclosing portion of the housing, said cover having a circular opening formed therethrough and a groove formed in an interior surface of said cover;

a groove formed on an interior surface of the operating mechanism enclosing portion of the housing opposite said groove in said cover when said cover is in place over said access opening in the housing;

a circular opening through a side wall of the operating mechansim-enclosing portion of the housing opposite said circular opening in said cover when said cover is in place over said access opening;

a polygon-shaped shaft, said shaft positioned so that one end thereof is located in said circular opening in said cover, and the other end is located in said circular opening in the housing;

first and second journal members, said journal members each having a circular portion that mates for rotation in said circular openings in said cover and the housing to freely rotate therein and have a polygon-shaped recess in the end of said circular portion that mates with the end of said polygon-shaped shaft; said first and second journal members being attached to respective ends of said polygon-shaped shaft wherein at least one of said journal members has a radially-extending lever portion for effecting rotation thereof, so that when said journal members are pivoted, said shaft rotates;

a first lever arm assembly locked at one end thereof to said polygon-shaped shaft;

a second lever arm assembly pivotably connected to the other end of said first lever arm assembly intermediate the ends of said second lever assembly; said second lever arm assembly being pivotably connected to one end to the movable contact;

a guide pin attached to the other end of said second lever arm assembly said shaft dimensioned to engage and slidably ride in said grooves in said housing and said cover, whereby motion of the other end of said lever is defined by said grooves in said housing and said cover.

15. In a high voltage circuit interrupter arrangement for interrupting current flow in an electrical circuit including an integrally formed hollow unitary housing formed of an insulating material, the housing including an operating mechanism-enclosing portion having a hollow interior, and an interrupter portion having a hollow interior, the hollow interiors communicating with one another, a stationary contact mounted within the hollow interior of said interrupter portion, a movable contact normally engaging the stationary contact, an improvement comprising:

an operating mechanism connected to the movable contact, said operating mechanism having a guide pin;

a cover for sealing an access opening in a side wall of the operating mechanism enclosing portion of the housing, said cover having a circular opening formed therethrough and a first groove formed in an interior surface of said cover;

a second groove formed on an interior surface of the operating mechanism enclosing portion of the housing opposite said first groove in said cover when said cover is in place over said access opening in the housing;

said first and second groove engaging said guide pin and cooperating with said operating mechanism to permit said guide pin to freely move in said first and second grooves when said operating mechanism operates to move the movable contact.

* * * * *